US010060304B2

(12) United States Patent
Meusel et al.

(10) Patent No.: US 10,060,304 B2
(45) Date of Patent: Aug. 28, 2018

(54) VALVE CONTROL SYSTEM HAVING AN ADJUSTABLE CAMSHAFT

(71) Applicant: ThyssenKrupp Presta TecCenter AG, Eschen (LI)

(72) Inventors: Juergen Meusel, Dittmannsdorf (DE); Michael Kunz, Chemnitz (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 134 days.

(21) Appl. No.: 15/313,032

(22) PCT Filed: Apr. 22, 2015

(86) PCT No.: PCT/EP2015/058680
§ 371 (c)(1),
(2) Date: Nov. 21, 2016

(87) PCT Pub. No.: WO2015/180896
PCT Pub. Date: Dec. 3, 2015

(65) Prior Publication Data

US 2017/0204751 A1 Jul. 20, 2017

(30) Foreign Application Priority Data

May 27, 2014 (DE) ..... 10 2014 107 459

(51) Int. Cl.
*F01L 1/047* (2006.01)
*F01L 1/344* (2006.01)
(Continued)

(52) U.S. Cl.
CPC ..... *F01L 1/34413* (2013.01); *F01L 1/04* (2013.01); *F01L 1/047* (2013.01); *F01L 1/46* (2013.01);
(Continued)

(58) Field of Classification Search
CPC ..... F01L 2001/0473; F01L 2001/0475; F01L 1/344; F01L 1/34413; F01L 1/46
(Continued)

(56) References Cited

U.S. PATENT DOCUMENTS

2006/0207529 A1* 9/2006 Lawrence ..... F01L 1/047 123/90.6
2008/0257290 A1* 10/2008 Lettmann ..... F01L 1/047 123/90.17
(Continued)

FOREIGN PATENT DOCUMENTS

CN 1657746 A 8/2005
DE 4122251 A1 1/1992
(Continued)

OTHER PUBLICATIONS

Int'l Search Report for PCT/EP2015/058680 dated Jul. 13, 2015 (dated Jul. 20, 2015).
(Continued)

*Primary Examiner* — Jorge Leon, Jr.
(74) *Attorney, Agent, or Firm* — thyssenkrupp North America, Inc.

(57) ABSTRACT

A valve control system may include an adjustable camshaft that includes an outer shaft and an inner shaft that extends through the outer shaft. The valve control system may further include a phase shifter that comprises a first control element and a second control element that can be rotated relative to the first control element. The outer shaft and the inner shaft may each be connected with a control element. The valve control system may also include a stop coupled with the outer shaft in a torque-proof manner, as well as a counter-stop coupled with the inner shaft in a torque-proof
(Continued)

manner. A maximal angle of rotation of the inner shaft in the outer shaft may be determined by the stop bordering on the counter-stop.

20 Claims, 4 Drawing Sheets

(51) Int. Cl.
*F01L 1/04* (2006.01)
*F01L 1/46* (2006.01)
*F01L 1/02* (2006.01)

(52) U.S. Cl.
CPC . *F01L 2001/028* (2013.01); *F01L 2001/0473* (2013.01); *F01L 2001/0475* (2013.01)

(58) Field of Classification Search
USPC ..... 123/90.17
See application file for complete search history.

(56) References Cited

U.S. PATENT DOCUMENTS

2010/0050967 A1* 3/2010 Lancefield ..... F01L 1/022 123/90.17
2011/0120401 A1* 5/2011 Scherzinger ..... F01L 1/047 123/90.17
2012/0160055 A1* 6/2012 Tateno ..... F01L 1/3442 74/567
2012/0160197 A1* 6/2012 Matsunaga ..... F01L 1/0532 123/90.15
2013/0055977 A1* 3/2013 Takahashi ..... F01L 1/3442 123/90.17
2013/0213329 A1* 8/2013 Nakamura ..... F01L 1/3442 123/90.16
2014/0238184 A1* 8/2014 Kunz ..... F16H 25/14 74/567

FOREIGN PATENT DOCUMENTS

DE 10335423 A1 2/2005
DE 10 2008 005 292 A1 7/2009
DE 10 2009 008 871 A1 8/2010
EP 1726789 B1 11/2006
GB 2424256 A 9/2006
WO 99/58821 A1 11/1999

OTHER PUBLICATIONS

German Examination Report (no English translation available).
English Language Abstract for DE 10 2008 005 292 A1.
English Language Abstract for DE 10 2009 008 871 A1.
English Language Abstract for DE 10335423 A1.
English Language Abstract for WO 99/58821 A1.
Chinese Office Action issued in corresponding application No. CN 201580029173.9, dated Jul. 3, 2018. [English translation unavailable].

* cited by examiner

VALVE CONTROL SYSTEM HAVING AN ADJUSTABLE CAMSHAFT

CROSS REFERENCE TO RELATED APPLICATIONS

This application is a U.S. National Stage Entry of International Patent Application Ser. No. PCT/EP2015/058680, filed Apr. 22, 2015, which claims priority to German Patent Application No. DE 10 2014 107 459.9 filed May 27, 2014, the entire contents of both of which are incorporated herein by reference.

FIELD

The present disclosure relates to valve control systems and, more particularly, to valve control systems with adjustable camshafts.

BACKGROUND

A valve control system of the stated type is known from DE 10 2008 005 292 A1. The valve control system has an adjustable camshaft, and the adjustable camshaft is composed of an outer shaft and an inner shaft, and cam elements are rotatably accommodated on the outer shaft, which elements are connected with the inner shaft by way of bolts. When the inner shaft is rotated in the outer shaft, the cam elements on the outer shaft rotate together with the inner shaft. Furthermore, firmly disposed cam elements are situated on the outer shaft, and when the inner shaft is rotated in the outer shaft during operation of the valve control system, by a phase shifter, the control times of inlet valves and outlet valves, for example, can be determined separately in this manner.

The phase shifter serves to rotate the inner shaft in the outer shaft. The phase shifter comprises a first control element, formed by a stator, and a second control element, formed by a rotor, which is accommodated in the stator so as to rotate. Multiple vane elements are disposed on the rotor, and the vane elements can be hydraulically impacted in vane cells, so that rotation of the second control element, in other words the rotor, in the first control element, in other words the stator, is made possible.

By means of coupling the first control element, for example with the outer shaft, and the second control element, for example with the inner shaft, the rotation of the second control element in the first control element is transferred to the adjustable camshaft.

During operation of a valve control system having an adjustable camshaft and having a phase shifter, rotation of the inner shaft in the outer shaft frequently occurs during a very short time; this is made possible by a correspondingly strong hydraulic action on the vane elements in the hydraulic vane cells. It is disadvantageous that in this regard, harmful contact of the vane elements with what are called early and late stops can come about, and the stops are formed by the walls of the chambers in the stator. Specifically if large adjustment angles are required, vane elements that have a relatively thin structure must be affixed to the rotor. Vane elements that have a particularly thin structure can experience damage if strong fluid action is required for very short-term adjustment of the rotational position of the inner shaft in the outer shaft.

Furthermore, adjustable camshafts have bolts for connecting the rotatable cam elements with the inner shaft, and the bolts are passed through passages in the outer shaft. These passages have a restricted elongated expanse in the circumference direction of the outer shaft, and the bolts can be rotated in the passages over the desired angle of rotation. In this regard, the bolts can make contact with the end regions of the passages, and this can also cause damage of the adjustable camshaft, so that contact of the bolts with the passages should be avoided.

DETAILED DESCRIPTION

Figure 1:
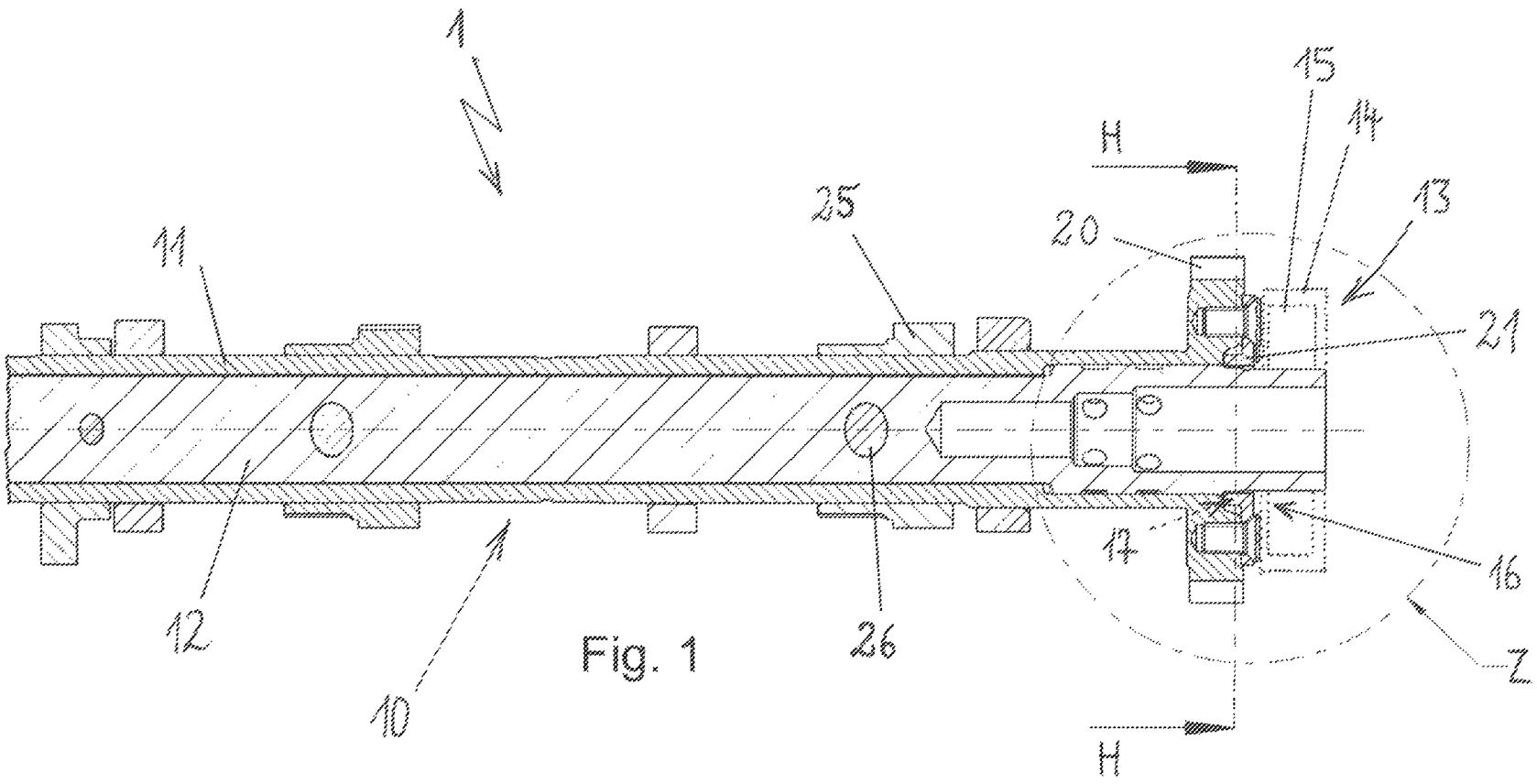
FIG. 1 is a cross-sectional view of an example valve control system having an adjustable camshaft and a phase shifter.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims.

The present disclosure generally relates to valve control systems that include, at least in some examples, at least one adjustable camshaft, an outer shaft and an inner shaft extending through the outer shaft, and at least one phase shifter, comprising a first control element and a second control element that can be rotated relative to the first control element, wherein the outer shaft and the inner shaft are each connected with a control element.

An object of the invention is the further development of a valve control system having an adjustable camshaft and having a phase shifter, wherein it is supposed to be possible to operate the valve control system without damage at large adjustment angles of the inner shaft in the outer shaft. In particular, damage caused by a restriction of the angle of rotation of the inner shaft in the outer shaft is supposed to be avoided.

The invention includes the technical teaching that at least one stop is provided, which is coupled with the outer shaft in torque-proof manner, and that at least one counter-stop is provided, which is coupled with the inner shaft in torque-proof manner, wherein the maximal angle of rotation of the inner shaft in the outer shaft is determined by the stop bordering on the counter-stop.

In this regard, the invention proceeds from the advantageous possibility of utilizing a stop and a counter-stop, independent of the restricted angle of rotation of the second control element in the first control element of the phase shifter and independent of the restriction of an angle of rotation of a bolt in a passage of the outer shaft, by means of which stop the angle of rotation of the inner shaft in the outer shaft of the adjustable camshaft and thereby of the second control element in the first control element of the phase shifter is restricted. In this regard, according to the invention, a stop is provided, which can enter into interaction with a counter-stop, wherein the stop on the outer shaft and the counter-stop on the inner shaft are coupled in torque-proof manner. Analogous to this, a stop can also be provided on the inner shaft, which stop can enter into interaction with a counter-stop on the outer shaft. In this regard, the stop enters into interaction with the counter-stop mechanically, in that the stop has a surface that comes into contact with a counter-surface on the counter-stop. The separate restriction of the angle of rotation allows a robust design, independent of relatively thin vane elements in the phase shifter and independent of bolts being passed through passages in the outer shaft of the adjustable camshaft. Consequently, neither the vane elements in the phase shifter nor the bolts and the passage of the outer shaft, in particular, need to satisfy special strength requirements, because a restriction of the angle of rotation is already achieved previously, according to the invention, by means of the stop in interaction with the counter-stop.

The valve control system according to the invention can comprise one or more camshafts. For example, the valve control system can have two camshafts disposed parallel to one another, which are particularly coupled with one another. In this regard, coupling can take place, for example, by way of what are called dual-phase shifters, so that phase shifters are disposed on one of the two or on both camshafts, and these can stand in an active connection with one another. In this regard, the stop and the counter-stop according to the invention can be disposed on one or on both camshafts.

For example, the stop can be formed by at least one claw, and the counter-stop can have projections between which at least one recess is formed. The at least one claw can project into this recess. For example, the counter-stop can be configured with a number of projections, by which the same number of recesses is produced, and, in accordance with the number of recesses, the stop has the same number of claws, so that a claw projects into every recess, for example. It is advantageous if the stop is configured in crown-like manner, and the counter-stop is configured in star shape, so that the number of claws corresponds to the number of projections or recesses, respectively.

The valve control system can comprise a drive wheel that is disposed on the outer shaft and serves for rotational drive of the adjustable camshaft. In this regard, a stop disk can be provided and accommodated on the drive wheel, which disk has at least one claw and preferably also multiple claws for forming the stop. In this regard, the counter-stop can be disposed on the inner shaft and, in particular, can be formed on it, particularly in one piece, as at least one projection, preferably also multiple times, and the projection or projections can stand in interaction with the stop disk. In particular, the projections can extend into interstices between the claws formed on the stop disk. According to an alternative variant for forming the stop and the counter-stop, the stop can be configured as a claw extension and disposed at the end side on the outer shaft or formed onto it. In this regard, interstices can be formed between the claws of the claw extension. According to this variant, the counter-stop can be formed by a journal element that is disposed on the inner shaft, corresponding to the claw extension, wherein journals of the journal element can project radially outward into the interstices of the claw extension. The variant for forming the stop and the counter-stop, formed by a claw extension and by a journal element, can also be subsequently placed onto a valve control system even without modification of existing camshaft designs, and the claw extension can be configured in one piece with the outer shaft, and the journal element can be affixed to the face side of the inner shaft with a screw element, for example.

According to an advantageous exemplary embodiment, the stop can have four claws or four claw extensions and the counter-stop can have four recesses or four interstices. As a result, the adjustable camshaft or the phase shifter is given a stop that is able to withstand a lot of stress and can be designed to be wear-resistant, and even at great hydraulic stresses of the vane elements of the phase shifter, the restriction of the angle of rotation of the inner shaft in the outer shaft can be designed in wear-free manner.

To drive the valve control system, it can have a drive wheel, for example a chain wheel or a toothed-belt wheel. The drive wheel serves for rotational drive of the adjustable camshaft and is driven by way of the traction means, in other words, for example, by way of a chain or a toothed belt, by means of the crankshaft of an internal combustion engine. In this regard, the stop can be integrated into the drive wheel, for example. For this purpose, the counter-stop can be configured in the hub region of the drive wheel, on the inner shaft, for example, wherein the drive wheel is connected with the outer shaft; for example, it can be welded onto the tubular outer shaft. The projections of the counter-stop can face radially outward and can make contact with the claws on the stop disk, which project away axially, for example. In this regard, the claws can also be configured in one piece with the drive wheel and can be formed on it, for example.

According to another advantageous variant, the stop and the counter-stop can be integrated into the phase shifter. For example, the stop disk can also be disposed on the phase shifter, for example on the first control element. In this regard, the counter-stop can be disposed on the second control element, for example, and can interact with the claws on the stop disk.

The valve control system can be structured with the stop and the counter-stop according to the invention, in such a manner that the angle of rotation of the inner shaft in the outer shaft, which is restricted by the stop and the counter-stop, respectively, is smaller than the maximal angle of rotation of the second control element relative to the first control element. In particular, adjustable cam elements can be accommodated on the outer shaft, so as to rotate, which elements are connected with the inner shaft by a bolt, wherein the bolts are passed through passages in the outer shaft, and wherein the angle of rotation of the inner shaft in the outer shaft, which is restricted by the stop and the counter-stop, is smaller than the maximal angle of rotation of the bolts in the passages. In this way, it is avoided that the first control element forms a stop with the second control element. Furthermore, it is avoided that the bolts form a stop in the passages of the outer shaft, in order to restrict the angle of rotation of the inner shaft in the outer shaft.

The invention furthermore relates to an adjustable camshaft of a valve control system having an outer shaft and having an inner shaft that extends through the outer shaft, wherein a stop is provided, which is coupled with the outer shaft in torque-proof manner, and wherein a counter-stop is provided, which is coupled with the inner shaft in torque-proof manner, wherein the maximal angle of rotation of the inner shaft in the outer shaft is determined by the stop bordering on the counter-stop.

In this regard, the stop can be configured as a claw extension and be disposed on the end side of the outer shaft or formed on it, wherein interstices can be formed between the claws of the claw extension.

In particular, the counter-stop can be formed by a journal element, which can be disposed on the end side of the inner shaft, corresponding to the claw extension, wherein journals of the journal element project radially outward into the interstices of the claw extension.

The adjustable camshaft can be configured for coupling with a phase shifter, wherein the stop and/or the counter-stop can interact with the phase shifter. Furthermore, the adjustable camshaft, particularly the outer shaft, can be connected with a drive wheel or structured in one piece with it, and the stop and/or the counter-stop can interact with the drive wheel directly or using corresponding means, for example using a stop disk.

FIG. 1 shows, in a cross-sectional view, a valve control system 1 having an adjustable camshaft 10 and having a phase shifter 13. The adjustable camshaft 10 has an outer shaft 11 and an inner shaft 12, and the inner shaft 12 extends through the tubular outer shaft 11. On the outside, on the outer shaft 11, cam elements 25 are accommodated so as to rotate, and connected with the inner shaft 12 in torque-proof manner, using bolts 26, and when the inner shaft 12 is rotated in the outer shaft 11, the cam elements 25 rotate on the outside of the outer shaft 11, with the inner shaft 12.

The phase shifter 13, which is merely represented schematically, serves to produce the rotation of the inner shaft 12 in the outer shaft 11. In order to produce the rotation of the inner shaft 12 in the outer shaft 11, the phase shifter 13 has a first control element 14 and a second control element 15, and the control elements 14 and 15 can be configured as a stator and as a rotor, and can be acted on hydraulically, as known from DE 10 2008 005 292 A1.

Bordering on the phase shifter 13, a drive wheel 20 is connected with the outer shaft 11, by way of which wheel the camshaft 10 can be put into rotation. The adjustment of the angle of rotation of the inner shaft 12 in the outer shaft 11 takes place during operation of the camshaft 10, and, according to the exemplary embodiment shown, a stop disk 21, on which a stop 16 is configured, which can be brought into an active connection with a counter-stop 17 on the outer shaft 12, serves to restrict the angle of rotation of the inner shaft 12 in the outer shaft 1. First, Detail Z shown in the subsequent FIG. 2 will be described in greater detail.

Figure 2:
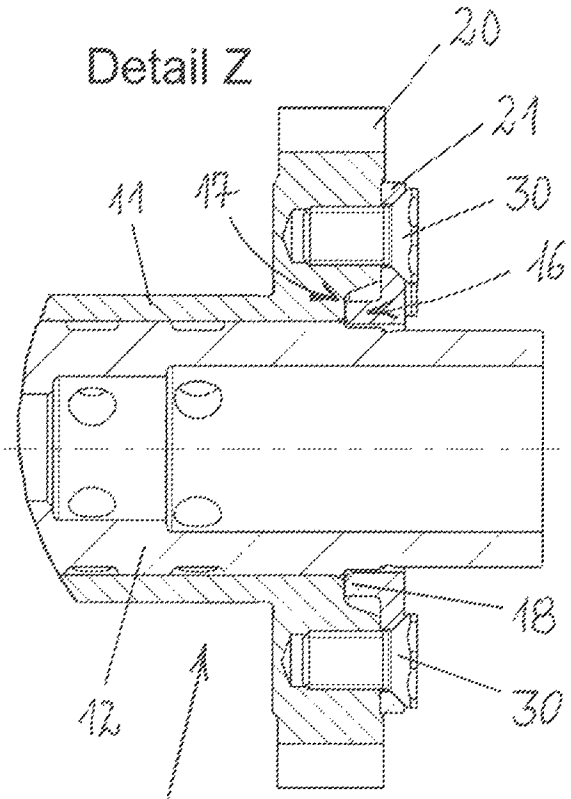
FIG. 2 is a cross-sectional view per a detail Z of the valve control system according to FIG. 1.

FIG. 2 shows Detail Z of the adjustable camshaft 10 with the outer shaft 11 and with the inner shaft 12 that extends through the outer shaft 11 and a drive wheel 20 is shown, which is connected with the outer shaft 11. Not shown is a phase shifter, in deviation from FIG. 1.

On a flat side of the drive wheel 20, a stop disk 21 is disposed by way of screw elements 30, and the stop disk 21 has stops 16, which project axially into the hub of the drive wheel 20, in the form of claws 18, out of the plane of the stop disk 21. In this regard, the claws 18 are situated above the outside of the inner shaft 12 and can enter into interaction with counter-stops, as will be explained in greater detail in connection with the subsequent FIG. 3, which represents a section along the section line H-H according to FIG. 1.

Figure 3:
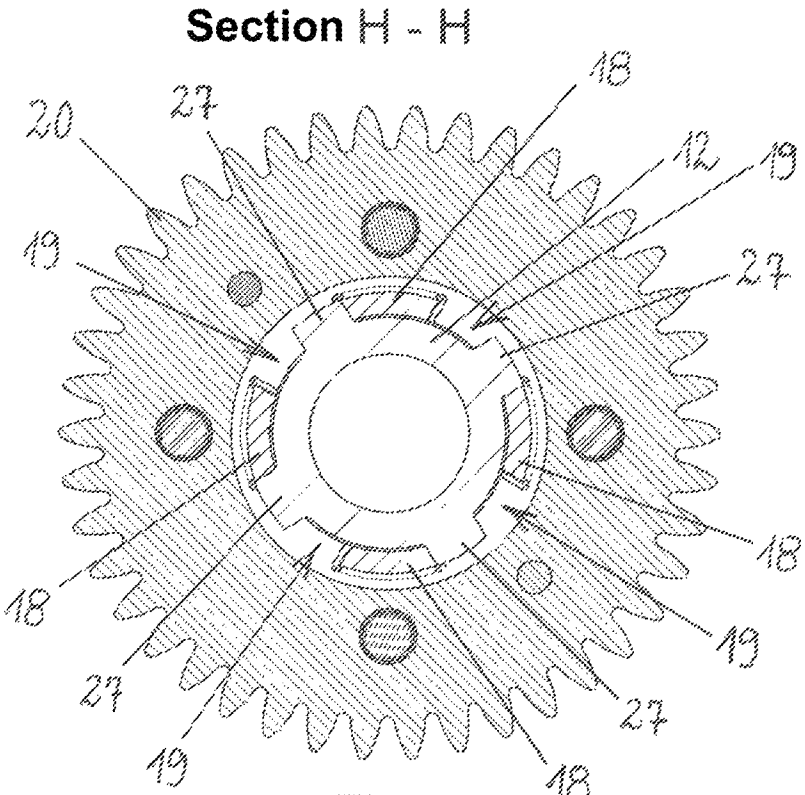
FIG. 3 is a sectional view of the valve control system of FIG. 1 taken along line H-H.

FIG. 3 shows a cross-section along the section line H-H through the drive wheel 20 according to FIG. 1, wherein the section line is configured in such a manner that the claws 18 also lie in the section plane, to form the stop 16 of the stop disk 21. The cross-sectional view makes it clear that counter-stops in the form of projections 27 are configured on the inner shaft 12, which projections project away radially outward from the inner shaft 12 and form the counter-stop 17. In this regard, the projections 27 extend into recesses 19, which are configured between the claws 18 of the stop disk 21. If the inner shaft 12 is now rotated in the outer shaft 11, the projections 27 make contact with the claws 18 in the circumference direction, so that the rotation of the inner shaft 12 in the outer shaft 11 is restricted.

The exemplary embodiment according to FIGS. 1 to 3 shows a stop disk 21 having four claws 18, so that four recesses 19 are formed between the claws 18. Projections 27 extend into each of the recesses 19, so that four projections 27 are configured on the inner shaft 12.

Figure 4:
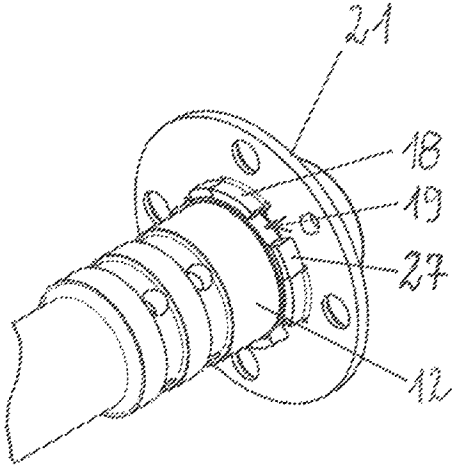
FIG. 4 is a perspective view of an example inner shaft with an example stop disk.

FIG. 4, in a perspective view, shows the stop disk 21 in place above the inner shaft 12, without the drive wheel 20 for accommodation of the stop disk 21 with the outer shaft 11 being shown. From the reduced view, it is evident that the projections 27 extend into the recesses 19 between the claws 18, and thereby, analogously, the claws 18 of the stop disk 21 extend into interstices between the projections 27. As the result of the interaction of the claws 18 with the projections 27 that becomes possible, the angle of rotation of the inner shaft 12 relative to the stop disk 21 is restricted.

Figure 5:
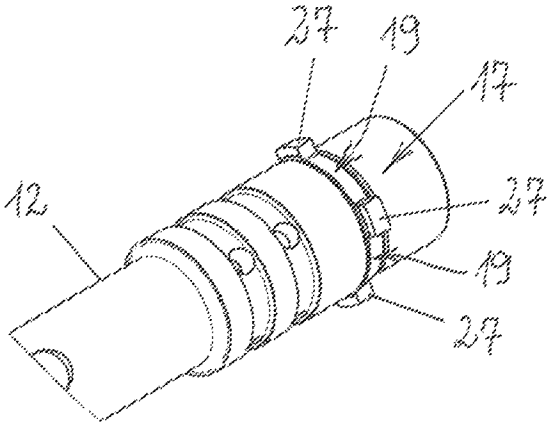
FIG. 5 is a perspective view of an example inner shaft without a stop disk.

FIG. 5, without the stop disk 21 according to FIG. 4, shows the inner shaft 12 with the projections 27, between which the recesses 19 are situated, thereby forming the counter-stop 17. The view shows four projections 27, which are configured in one piece with the inner shaft 12, and, for example, the inner shaft 12 can be prepared by working it with a lathe, and the recesses 19 are subsequently produced by means of intermittent milling work.

Figure 6:
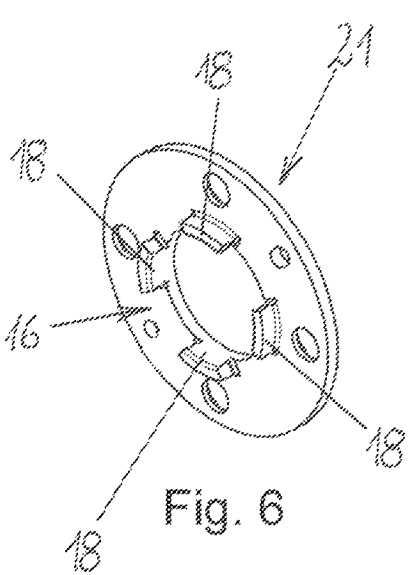
FIG. 6 is a perspective view of an example stop disk.

FIG. 6, finally, shows a perspective view of the stop disk 21 with the claws 18 that project away axially, and the stop 16 is formed by the claws 18, which stop can interact accordingly with the counter-stop 17 according to FIG. 5.

Figure 8:
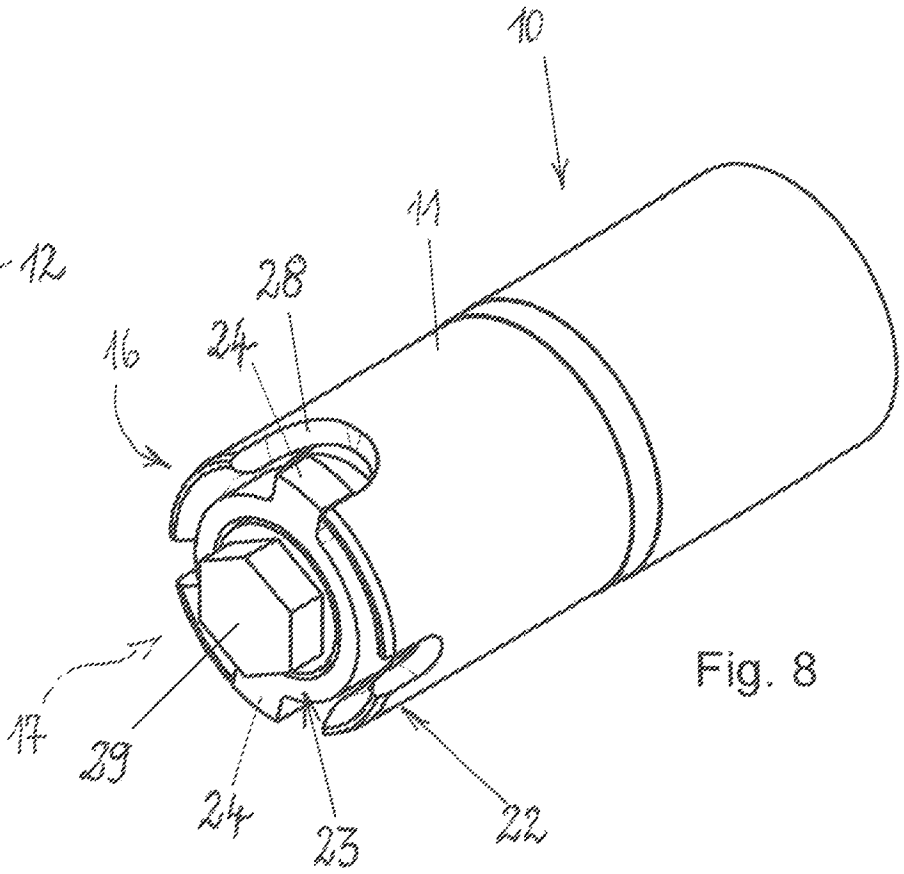
FIG. 8 is a perspective view of the adjustable camshaft according to FIG. 7, including the stop and the counter-stop.
Figure 7:
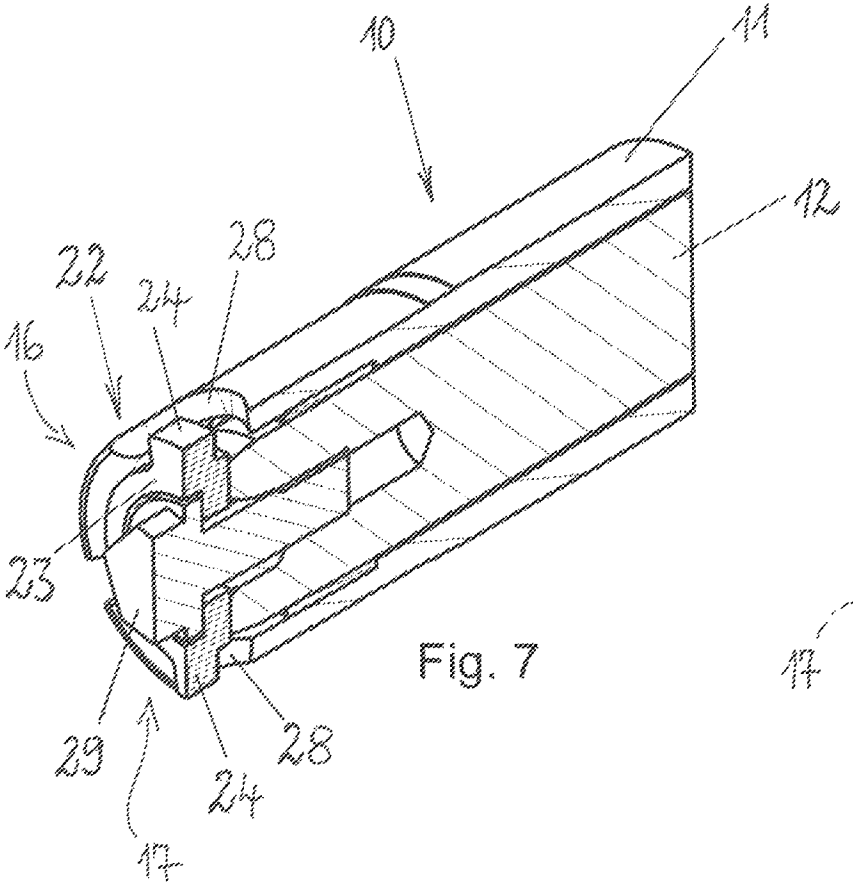
FIG. 7 is a cross-sectional perspective view of another example adjustable camshaft having a stop and a counter-stop.

FIGS. 7 and 8, in a sectional (FIG. 7) and a non-sectional (FIG. 8) perspective view, show a further embodiment variant for forming the stop 16 and the counter-stop 17, which are disposed on the end side of the adjustable camshaft 10 having the outer shaft 11 and the inner shaft 12. The stop 16 is configured on the end side of the outer shaft 11, in the form of a claw extension 22, and interstices 28 are formed by the claw extension 22. The end of the outer shaft 11 is therefore configured approximately in crown shape, and two interstices 28 are configured, for example. The counter-stop 17 is formed by a journal element 23, which is disposed on the end side of the inner shaft 12, corresponding to the claw extension 22. The journal element 23 has two journals 24 disposed diametrically opposite one another at 180°, which journals project radially outward into the interstices 28 of the claw extension 22. When the inner shaft 12 is rotated in the outer shaft 11, the journals 24 make contact with the edges of the interstices 28, thereby restricting the angle of rotation by the corresponding desired amount. The journal element 23 is affixed to the end side of the inner shaft 12 by way of a screw element 29, and thereby structured as an individual part.

The invention is not restricted, in its embodiment, to the preferred exemplary embodiments indicated above. Instead, a number of variants are conceivable, which make use of the solution presented even in fundamentally different types of embodiments. All the characteristics and/or advantages, including design details and spatial arrangement, which are evident from the claims, the specification or the drawings, can be essential to the invention both in themselves and in the most varied combinations.

What is claimed is:

1. A valve control system comprising:

an adjustable camshaft including an outer shaft and an inner shaft that extends through the outer shaft;

a phase shifter including a first control element and a second control element that is rotatable relative to the first control element, wherein the outer and inner shafts are each connected with one of the first or second control elements;

a stop coupled with the outer shaft in a torque-proof manner; and a counter-stop coupled with the inner shaft in a torque-proof manner, wherein a maximal angle of rotation of the inner shaft in the outer shaft is determined by the stop bordering on the counter-stop, wherein the maximal angle of rotation of the inner shaft in the outer shaft is less than a maximal angle of rotation of the second control element relative to the first control element.

2. The valve control system of claim 1 wherein the stop comprises a claw, wherein the counter-stop comprises a recess disposed between projections, wherein the claw of the stop projects into the recess of the counter-stop.

3. The valve control system of claim 2 further comprising:

a drive wheel disposed on the outer shaft for rotationally driving the adjustable camshaft; and a stop disk disposed on the drive wheel, the stop disk including the claw of the stop.

4. The valve control system of claim 3 wherein the stop is integrated into the drive wheel.

5. The valve control system of claim 4 wherein the counter-stop is configured in a hub region of the drive wheel on the inner shaft.

6. The valve control system of claim 3 wherein the counter-stop is disposed on the inner shaft and engages with the stop disk.

7. The valve control system of claim 6 wherein the counter-stop is integral with and projects from the inner shaft.

8. The valve control system of claim 1 wherein the stop is configured as a claw extension and is disposed or formed on an end side of the outer shaft, wherein interstices are disposed between claws of the claw extension.

9. The valve control system of claim 8 wherein the counter-stop comprises a journal element that is disposed on an end side of the inner shaft that corresponds to the claw extension, wherein journals of the journal element project radially outward into the interstices of the claw extension.

10. The valve control system of claim 1 wherein the stop includes four claws or four claw extensions, wherein the counter-stop includes four recesses or four interstices.

11. The valve control system of claim 1 wherein the stop and the counter-stop are integrated into the phase shifter.

12. A valve control system comprising:

an adjustable camshaft including an outer shaft and an inner shaft that extends through the outer shaft;

a phase shifter including a first control element and a second control element that is rotatable relative to the first control element, wherein the outer and inner shafts are each connected with one of the first or second control elements;

a stop coupled with the outer shaft in a torque-proof manner;

a counter-stop coupled with the inner shaft in a torque-proof manner, wherein a maximal angle of rotation of the inner shaft in the outer shaft is determined by the stop bordering on the counter-stop; and adjustable cam elements that are received on the outer shaft so as to rotate, wherein the adjustable cam elements are connected with the inner shaft by bolts that pass through passages in the outer shaft, wherein the maximum angle of rotation of the inner shaft in the outer shaft is less than a maximal angle of rotation of the bolts in the passages.

13. The valve control system of claim 12 wherein the stop comprises a claw, wherein the counter-stop comprises a recess disposed between projections, wherein the claw of the stop projects into the recess of the counter-stop.

14. The valve control system of claim 13 further comprising:

a drive wheel disposed on the outer shaft for rotationally driving the adjustable camshaft; and a stop disk disposed on the drive wheel, the stop disk including the claw of the stop.

15. The valve control system of claim 14 wherein the stop is integrated into the drive wheel.

16. The valve control system of claim 15 wherein the counter-stop is configured in a hub region of the drive wheel on the inner shaft.

17. The valve control system of claim 14 wherein the counter-stop is disposed on the inner shaft and engages with the stop disk.

18. the valve control system of claim 17 wherein the counter-stop is integral with and projects from the inner shaft.

19. The valve control system of claim 12 wherein the stop is configured as a claw extension and is disposed or formed on an end side of the outer shaft, wherein interstices are disposed between claws of the claw extension.

20. The valve control system of claim 12 wherein the stop and the counter-stop are integrated into the phase shifter.

* * * * *